United States Patent [19]

Dorcich

[11] 3,945,469

[45] Mar. 23, 1976

[54] ESCAPE ELEVATOR

[76] Inventor: Roy L. Dorcich, 1888 W. San Carlos St., San Jose, Calif. 95128

[22] Filed: Jan. 4, 1974

[21] Appl. No.: 430,885

[52] U.S. Cl. ..... 187/6; 182/142; 187/27; 187/28

[51] Int. Cl.[2] ..... B66B 9/00

[58] Field of Search ..... 187/1, 2, 6, 17, 27, 28, 187/42, 43, 29; 254/151, 154; 182/37, 142, 143, 144, 18, 19, 129

[56] References Cited

UNITED STATES PATENTS

| | | | |
|---|---|---|---|
| 279,814 | 6/1883 | Ripley | 187/27 X |
| 504,576 | 9/1893 | Gregory | 187/6 |
| 665,707 | 1/1901 | Tromanhauser | 187/27 X |
| 673,942 | 5/1901 | Curtis et al. | 182/37 |
| 736,947 | 8/1903 | Ekman | 182/142 |
| 786,641 | 4/1905 | Grossman | 187/6 |
| 1,104,685 | 7/1914 | Lofgren | 182/142 X |
| 1,996,984 | 4/1935 | Tracy | 187/28 |
| 1,997,260 | 4/1935 | Lindquist | 187/29 R |
| 2,420,903 | 5/1947 | Noble | 187/95 X |
| 2,602,524 | 7/1952 | Shirley | 187/29 R |
| 2,699,226 | 1/1955 | Bruns | 187/29 R |
| 3,053,344 | 9/1962 | Buck | 187/2 |
| 3,088,545 | 5/1963 | Meyer | 187/6 |
| 3,103,645 | 9/1963 | Savage | 187/29 R X |
| 3,468,401 | 9/1969 | Letz | 187/95 X |
| 3,610,371 | 10/1971 | Abbott | 187/29 R |

FOREIGN PATENTS OR APPLICATIONS

| | | | |
|---|---|---|---|
| 733,196 | 7/1955 | United Kingdom | 187/8 |

*Primary Examiner*—Evon C. Blunk
*Assistant Examiner*—James L. Rowland
*Attorney, Agent, or Firm*—Phillips, Moore, Weissenberger, Lempio & Strabala

[57] ABSTRACT

The invention comprises an escape elevator which is especially useful with tall buildings. The escape elevator slides up and down the outside of the building along a pair of spaced apart tracks. The tracks serve to hold the elevator close to the building as well as to provide guidance for the up and down motion of the elevator. The elevator car or cage extends to either side of the tracks sufficiently to overlap egresses from the building such as balconies. The power winches which operate the elevator are located adjacent the top of the building. A shielded cable is provided which leads from the winches to a point adjacent the ground floor of the building. A remote control box is attachable at the point adjacent the ground floor of the building. Also attachable at the control box is an external power supply to which power to operate the elevator is supplied. The elevator is thus not dependent upon the internal power supply of the building. The remote control device can be operated from a considerable distance from the building whereby the operator, who in most cases will be a fireman, can best observe the fire in the building and direct rescue and fire-fighting efforts.

9 Claims, 7 Drawing Figures

FIG. 1
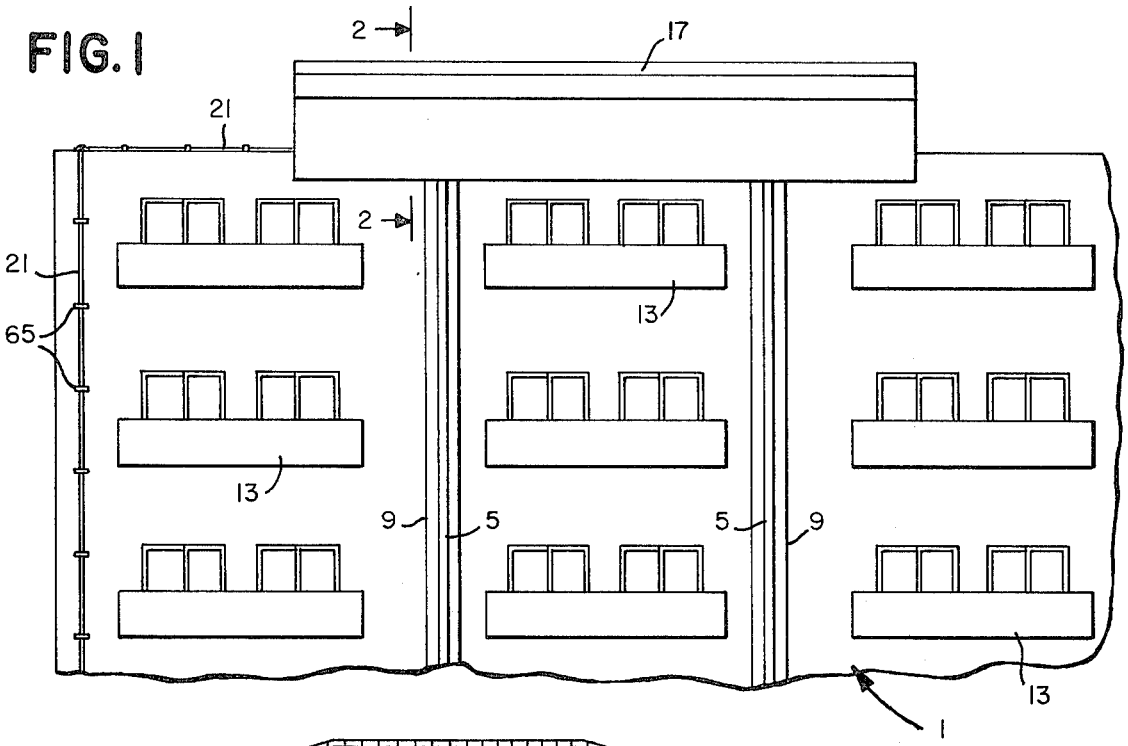
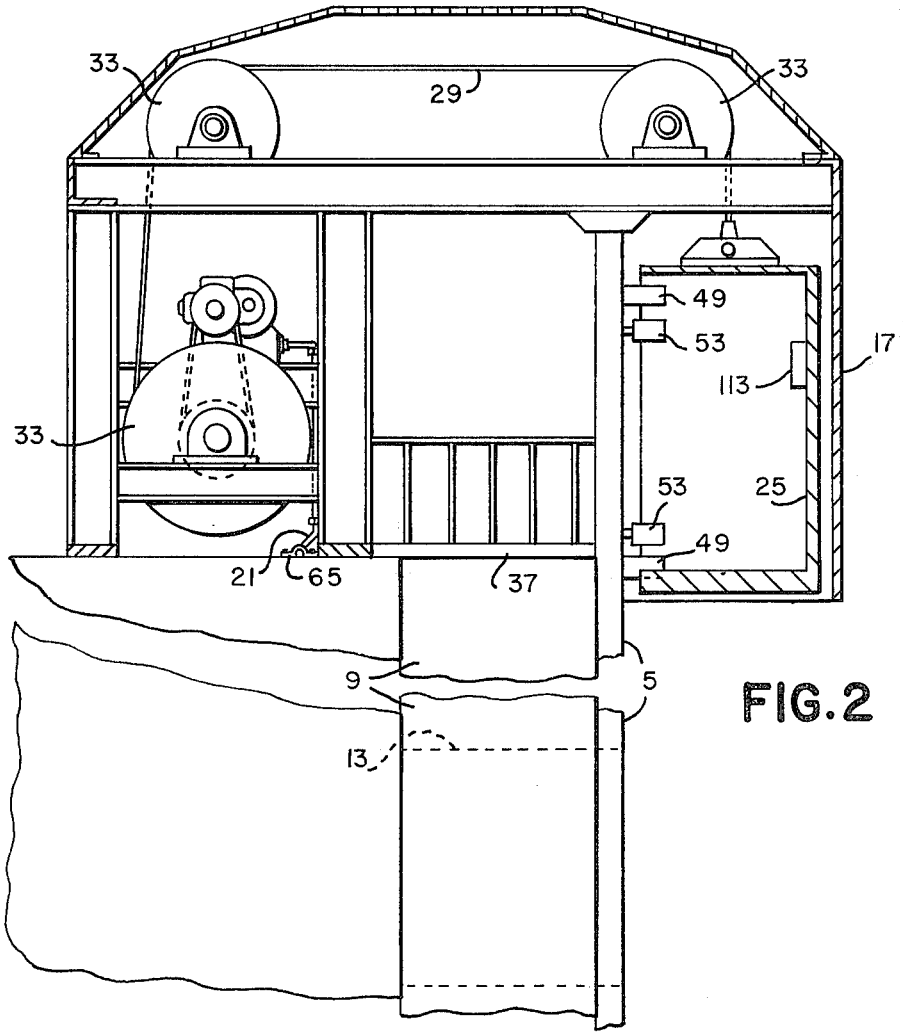
FIG. 2

ESCAPE ELEVATOR

BACKGROUND OF THE INVENTION

The prior art discloses a number of devices useful for escaping from a burning building. Some of these devices take the form of elevators which are lowered along the outside wall of the building. None of the devices disclosed by the prior art, however, include provision for remote operation and remote power supply. Nor do any of the prior art devices include provision for assuring that the car of the elevator will be held against the side of the building. These are important considerations, especially with the very high buildings presently being built. They are especially important considerations in windy areas where fires in tall buildings can be expected to spread very rapidly and where panic of the occupants of the building is a serious threat.

The present invention provides an escape elevator operable on external power and which is remotely controllable. The present invention further provides an escape elevator which has the aforementioned advantages and which further operates along a pair of tracks which serve to hold the elevator adjacent the building whereby the car of the elevator cannot be torn away from the building in high winds. These and other advances introduced by the present invention will be apparent from the description which follows.

SUMMARY OF THE INVENTION

The invention comprises an escape elevator which operates externally along the side of a building including means attached to the building for lifting and lowering the elevator; means for supplying external power to operate the elevator, the external power being supplied from a source removed from the building, and means for remotely controlling the elevator.

Preferably the escape elevator includes a fire-shielded electrical connector cable connecting the lifting and lowering means for the elevator to a point on the building adjacent the ground floor of the building. The remote controlling means and the power supplying means are preferably detachably attachable to the point. The remote controlling means preferably includes means for indicating the position of the elevator. The remote controlling means further preferably includes means for communicating with the elevator car.

In another sense, the escape elevator comprises a pair of tracks extending from adjacent the top of a building to adjacent the bottom of the building, an elevator car slidably attached to each of the tracks, the tracks serving to hold the elevator adjacent the building; and means attached to the building for lifting and lowering the elevator; in combination with:

means for supplying external power to operate the elevator, the external power being supplied from a source removed from the building, and means for remotely controlling the elevator. The car of the elevator preferably extends orthogonally to the tracks sufficiently to overlap a plurality of egresses from the building.

BRIEF DESCRIPTION OF THE DRAWINGS

The invention will be better understood by reference to the drawings wherein like numbers denote like parts throughout and wherein:

FIG. 1 illustrates a building having installed thereon the escape elevator of the invention.

FIG. 2 is a section view taken along line 2—2 of FIG. 1.

DETAILED DESCRIPTION OF THE PREFERRED EMBODIMENT

Figure 5:
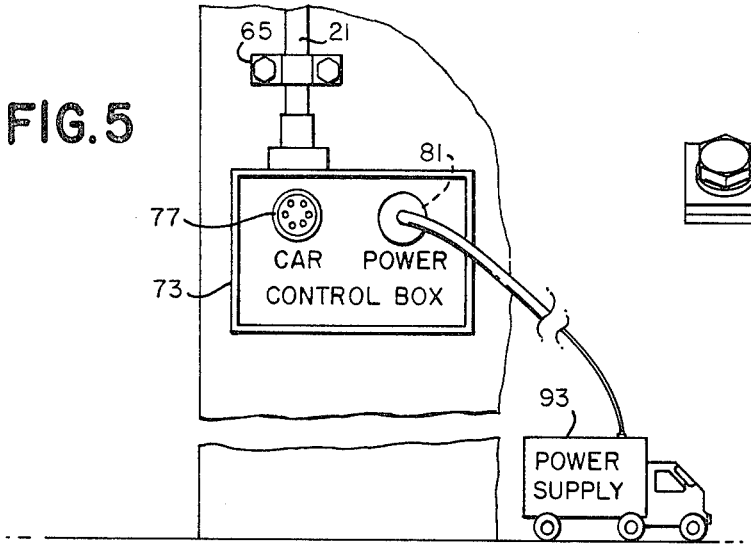
FIG. 5 illustrates a control box located at a point adjacent the ground floor of the building wherein a remote controller and power may be attached.

Referring first to FIG. 1, there is illustrated a building 1, a pair of tracks 5 running down along the side of the building upon vertical support columns 9, the building having a plurality of egresses therefrom and at different floors thereof, in particular, the balconies 13. Adjacent the top of the building is an elevator protective cage 17. A shielded cable 21 is shown running down the side of the building.

FIG. 2 is a section view illustrating the working mechanisms of the escape elevator. The cage 25 of the elevator is lowerable using the cable 29, the pulleys 33 and conventional winch and drive mechanisms. A walkway 37 is preferably provided to allow access to the cage 25 from the roof.

Figure 3:
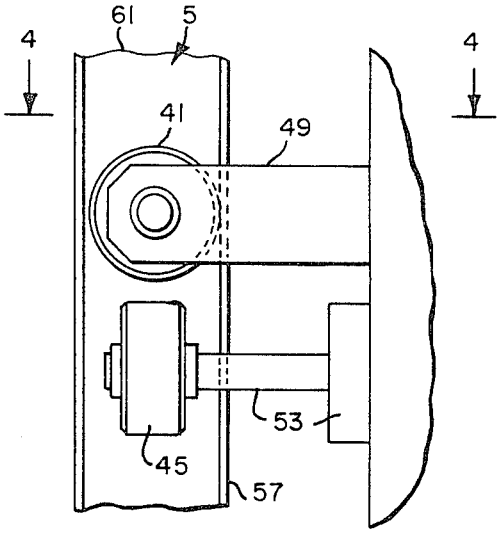
FIG. 3 is a side view illustrating tracks on which the elevator rides and the wheels which ride thereon.
Figure 4:
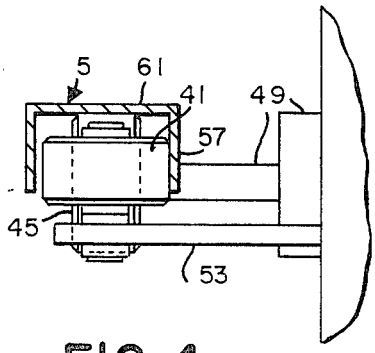
FIG. 4 comprises a section view taken along line 4—4 of FIG. 3.
Figure 7:
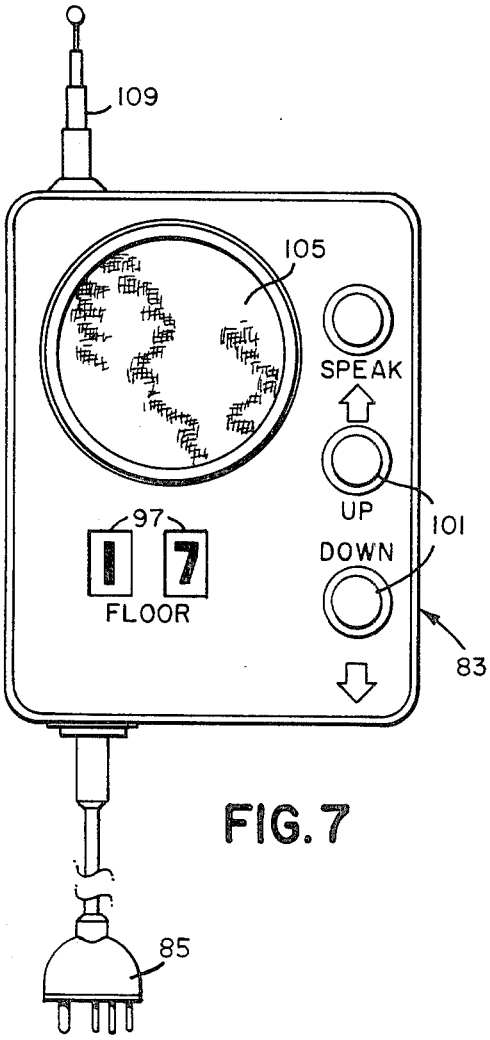
FIG. 7 illustrates a remote controller for operating the elevator.

The cage 25 rides within the tracks 5 through use of the wheel and axle combinations 41 and 45 as illustrated most clearly in FIGS. 3 and 4 which are attached to the cage 25 by the supports 49 and 53 respectively. As can be readily seen from FIG. 2, the cage 25 when it goes up or down along the tracks 5 must be far enough from the building so as to pass by the balconies 13. In the embodiment illustrated the proper spacing is accomplished by placing the tracks 5 on the columns 9.

As will be most readily apparent by reference to FIGS. 3 and 4, the rails 5 are designed to have a forward portion thereof 57 serve to hold the cage 25 adjacent the building 1 through contact with the wheel-axle combination 41. The cage 25 is kept from moving sideways by the rails 5 because the wheel-axle combinations 45 run along the side 61 of the track 5. Thus the cage 25 is firmly held against the building 1 and cannot be easily dislodged therefrom even under highly windy conditions.

Figure 6:
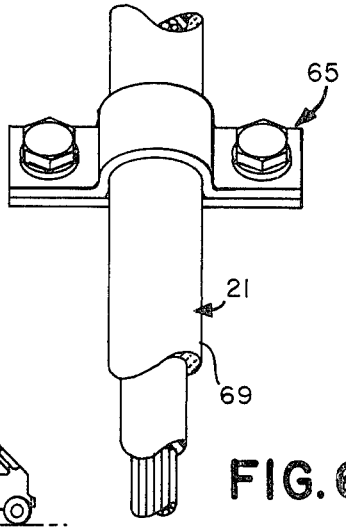
FIG. 6 illustrates a cable shielded against fire damage which leads from adjacent the ground floor of the building to the means for lifting and lowering the elevator.

FIGS. 1, 5 and 6 illustrate a clamping means 65 which can advantageously be used to fasten the cable 21 against the side of building 1. It is preferred that the cable 21 go down along the outside of the building 1 so that any fire within the building 1 will not in any way affect the cable 21.

As will be most apparent from FIG. 6, the cable 21 contains an external shielding sleeve 69 thereon of a fireproof material to further protect the cable 21 from damage by fire.

The cable 21 as illustrated in FIG. 5 terminates in the control box 73. The control box 73 includes a control hookup plug 77 and a power plug 81. Remote controller 83 is attachable to the outlet 77 via the plug 85. As is illustrated in FIG. 5 an external power supply 93 is attached to the outlet 81 at the control box 73.

The remote controller 83 includes a floor indicator 97, up and down control buttons 101, a speaker-microphone 105 and an antenna 109. A speaker-microphone arrangement 113 is also included in the cage 25 to provide intercommunication between the remote control operator and the occupants of the cage 25.

In operation it is anticipated that the remote controller 83 will be operated by a fireman via a long cable so that the fireman can be far enough from the building to observe the progress of a fire in the building. It is further anticipated that a fireman may ride in the cage 25 up to a floor adjacent the fire so as to better be able to direct fire-fighting operations making use of the communicating equipment. It is further expected that the external power supply 93 will be a mobile power supply carried by a fire truck or a special power truck.

Briefly, a fire alarm will be set off when a fire occurs in a high-rise building to summon firemen to the scene. The firemen will then plug in the external power supply 93 and the remote controller 83 at the control box 73. Sufficient cable will be used to connect both the power supply 93 and the remote controller 83 so that the operator is in no danger and the power supply is in no danger. If he so desires the operator of the remote controller 83 can ascend in a building across the street from the burning building so as to obtain a better view of the fire. The cage 25 of the elevator will then be directed, using the remote controller 83, to an appropriate floor for loading on the occupants of the building who are above the fire. These occupants can then be removed by causing the cage 25 to descend in the normal manner to the ground level. Firemen can be let off at floors above and below the fire to direct the occupants away from the burning area.

It is clear that the external elevator has a number of advantages over internal elevators. First, an internal elevator is dependent upon the power supply of the building. Second, fire tends to burn internally of the building whereas the external surface of the building tends to escape the most serious ravages of the fire. Third, with the remote control provided herein, it is possible to evacuate people from a burning building with considerably less danger. Fourth, the elevator of the invention is designed so as to be held close to the side of a building even in high winds. Fifth, with the use of an external elevator, it is not necessary for the elevator to go directly through the area within the building where a fire is burning. Sixth, the external elevator can be made wide enough to extend over a plurality of egresses from the building at each floor of the building. Thus, it is not necessary to congregate all of the people being rescued at a particular egress.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. An escape and fire fighting elevator which operates externally along a side of a multi-story building, comprising:

an electric motor attached atop the building;

winch means atop the building driven by said motor for winding in and out a cable;

an elevator cage attached to an end of said cable;

a pair of spaced apart tracks extending along the side of said building from adjacent the top thereof to adjacent the bottom thereof;

a pair of track following means extending from said cage to said tracks, said tracks including means for holding said cage adjacent the building and means for preventing said cage from moving sideways;

a fire-shielded electrical connector connecting said electric motor to a control box external of the building and adjacent the ground floor thereof;

a mobile electrical power supply removed from said building and detachably attachable via an electrical power line to said control box;

a control cable one end of which is detachably attachable to said control box; and a remote controller attached to the other end of said control cable, said control cable being long enough so that an operator of said remote controller can be far enough from said building to observe the progress of a fire therein.

2. An elevator as in claim 1, wherein the remote controller includes means for visually and directly numerically indicating the floor opposite which the cage is located.

3. An elevator as in claim 2, including means for verbally communicating information between the operator of the remote controller and an occupant in the cage.

4. An elevator as in claim 3, wherein the cage includes an always open entranceway facing the side of the building.

5. An elevator as in claim 4, wherein said car extends orthogonally to said tracks sufficiently to overlap a plurality of egresses from the building.

6. An elevator as in claim 5, wherein said connector is external of and runs down along the outside of said building.

7. An elevator as in claim 6, wherein said tracks each include a forward portion parallel to and removed from said building which serves as said means for holding said cage adjacent the building and a side portion running from said forward portion to adjacent the building which serves as said means for preventing said cage from moving sideways and wherein said track following means comprises a first pair of wheels riding on the building side of said forward portions and a second pair of wheels riding on said side portions.

8. An elevator as in claim 7, wherein said tracks each are spaced away from said building by locating them upon a pair of columns which extend from adjacent the top of said building to adjacent the bottom thereof.

9. An elevator as in claim 8, including means for entering said cage from the roof of said building.

* * * * *